United States Patent [19]

Kawata et al.

[11] Patent Number: 4,647,526

[45] Date of Patent: Mar. 3, 1987

[54] HEAT-DEVELOPABLE LIGHT-SENSITIVE MATERIAL

[75] Inventors: Ken Kawata; Yoshiharu Yabuki; Kozo Sato; Hiroyuki Hirai, all of Kanagawa, Japan

[73] Assignee: Fuji Photo Film Co., Ltd., Kanagawa, Japan

[21] Appl. No.: 768,281

[22] Filed: Aug. 22, 1985

[30] Foreign Application Priority Data

Aug. 22, 1984 [JP] Japan ..... 59-173162

[51] Int. Cl.[4] ..... G03C 1/02

[52] U.S. Cl. ..... 430/353; 430/351; 430/570; 430/617; 430/619; 430/620; 430/955; 430/151; 430/171; 430/543; 430/559; 430/562

[58] Field of Search ..... 430/617, 619, 955, 203, 430/151, 179, 171, 351, 353, 570, 620

[56] References Cited

U.S. PATENT DOCUMENTS 3,220,846 11/1965 Tinker et al. ..... 430/151
4,487,826 12/1984 Watanabe et al. ..... 430/151
4,514,493 4/1985 Hirai et al. ..... 430/617

FOREIGN PATENT DOCUMENTS 909491 10/1962 United Kingdom ..... 430/151

*Primary Examiner*—Won H. Louie
*Attorney, Agent, or Firm*—Sughrue, Mion, Zinn, Macpeak and Seas

[57] ABSTRACT

A heat-developable light-sensitive material is described which is capable of providing images of high density and low fog in a short period of time, and which is excellent in stability. The heat-developable light-sensitive material comprises a support and formed thereon a heat developable light-sensitive layer, wherein said light-sensitive material contains at least one compound selected from the group consisting of compounds represented by formulae (I), (II), (III) and (IV) as a base precursor (I)

(II)

(III)

(IV)

wherein symbols represent the same groups as defined in claim 1.

21 Claims, No Drawings

HEAT-DEVELOPABLE LIGHT-SENSITIVE MATERIAL

FIELD OF THE INVENTION

The present invention relates to a heat-developable light-sensitive material, and more particularly to a material containing a novel base precursor.

BACKGROUND OF THE INVENTION

In general, it is preferable to use a base in a heat-developable light-sensitive material for the purpose of accelerating the heat development of said material, and it is necessary to incorporate said base in said light-sensitive material in the form of a base precursor for increasing the stability of said material. In order to use such base precursor practically, which means herein a compound capable of being decomposed under heat to be able to release a basic component, it is necessary that said base precursor must have both stability at normal temperature and rapid decomposability under heat.

Various kinds of conventional base precursors have heretofore been known including, for example, ureas as described in U.S. Pat. No. 2,732,299 and Belgian Patent No. 625,554; urea or ammonium salts of urea and weak acid as described in Japanese Patent Publication No. 1699/65; hexamethylene-tetramines or semicarbazides as described in U.S. Pat. No. 3,157,503; combinations of triazine compound and carboxylic acid as described in U.S. Pat. No. 3,493,374; dicyan-diamide derivatives as described in U.S. Pat. No. 3,271,155; N-sulfonylureas as described in U.S. Pat. No. 3,420,665; amine-imides as described in "*Research Disclosure*" (1977), RD No. 15776; and salts of decomposable acids such as trichloroacetic acid as described in British Patent No. 998,949.

However, image forming materials containing such conventional base precursors have serious defects. In particular, such conventional base precursors do not fully satisfy the properties desired both with respect to high stability during preservation at normal temperature (e.g., 0°–30° C.) and rapid decomposability during development treatment under heat. Therefore, a high and sufficient image density cannot be obtained, or the S/N (signal/noise) value of the formed image extremely decreases, as the base component tends to be released from said base precursor during preservation thereof, and these phenomena are extremely serious problems.

SUMMARY OF THE INVENTION

Accordingly, one object of the present invention is to provide a heat-developable light-sensitive material having high time-stability and capable of forming an image of high image quality.

Another object of the present invention is to provide a heat-developable light-sensitive material containing a novel base precursor which is especially effective for forming a good image having a high image density with less fog.

Still another object of the present invention is to provide a heat-developable light-sensitive material capable of rapidly obtaining an image of high density in a short period of time.

In order to achieve said objects, the present invention provides a heat-developable light-sensitive material containing at least one compound selected from the group consisting of compounds represented by formulae (I), (II), (III) and (IV) as a base precursor.

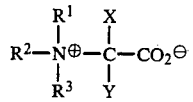

(I)

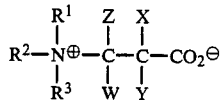

(II)

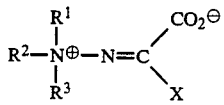

(III)

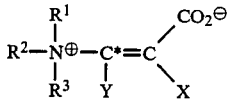

(IV)

In the above formulae, $R^1$, $R^2$, and $R^3$ each independently represents a hydrogen atom, an alkyl group, a substituted alkyl group, a cycloalkyl group, an alkenyl group, an alkynyl group, an aryl group, a substituted aryl group, an aralkyl group, a substituted aralkyl group, an imino group of formula

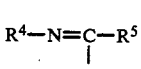

or an amidino group of formula wherein $R^4$ through $R^7$ each independently represents a substituent selected from an alkyl group, a substituted alkyl group, a cycloalkyl group, an alkenyl group, an aryl group, and an aralkyl group, or two of said substituents $R^1$ through $R^7$ together form a ring;

W, X, Y, and Z each independently represents a hydrogen atom, an alkyl group, a substituted alkyl group, a cycloalkyl group, an alkenyl group, an alkynyl group, an aryl group, a substituted aryl group, an alkoxy group, an aryloxy group, an aralkyl group, a substituted aralkyl group, an alkylcarbonylamino group, an arylcarbonylamino group, a halogen atom, an alkylthio group, an arylthio group, an alkylcarbonyloxy group, an arylcarbonyloxy group, a cyano group, an alkylcarbonyl group, an arylcarbonyl group, an alkylsulfinyl group, an arylsulfinyl group, a carbamoyl group, a substituted carbamoyl group, a sulfamoyl group, a substituted sulfamoyl group, an ureido group, a substituted ureido group, a sulfamoylamino group, a substituted sulfamoylamino group, an alkylsulfonyl group, an arylsulfonyl group, an alkyl sulfonylamino group, an arylsulfonylamino group, an alkoxycarbonyl group, an alkoxycarbonylamino group, an aryloxycarbonyl group, an aryloxycarbonylamino group, a heterocyclic ring residue and a substituted heterocyclic ring residue, or said X and Z together form a ring. In the formula (IV), C* represents that the carbon atom is able to have any bonding structure to form any optical isomer. In other words, the formula (IV) includes all optical isomers.

The structural characteristics of the base precursors of the present invention as defined above results in the fact that they are extremely stable at normal temperature and may easily be decarboxylated when heated so as to be able to release a base therefrom. As a result, the base precursors of the present invention satisfy the desired properties of stability preservation at normal temperature and the rapid decomposability (release of base component) upon development treatment under heat. The use of the base precursor of the present invention has thus overcome the above-mentioned defects in prior arts, resulting in provision of image forming heat-developable material of improved high quality.

DETAILED DESCRIPTION OF THE INVENTION

The total carbon atom number of compounds obtained after decarboxylation of the compound represented by formulae (I) through (IV) is preferably from 3 to 36, more preferably from 4 to 20, and most preferably from 6 to 8. Examples of substituents of $R^1$ through $R^7$, W, X, Y and Z include an alkyl group, an alkenyl group, an alkynyl group, an aryl group, and an aralkyl group.

The base precursor of the present invention may be used in a broad range. The useful range thereof is 50 wt.% or less, on the basis of the total weight of the coated dry film of the light-sensitive material to which the base precursor is added, and is especially preferably within the range of from 0.01 wt.% to 40 wt.%.

Typical examples of base precursors which may be used in the present invention are illustrated below, without restriction on the scope of the present invention. Examples of compounds of formula (I):

(1) $(CH_3)_3\overset{\oplus}{N}-CH_2CO_2^{\ominus}$ (2) $(C_2H_5)_3\overset{\oplus}{N}CH_2CO_2^{\ominus}$ (3) $(CH_3)_3\overset{\oplus}{N}-CHCO_2^{\ominus}$

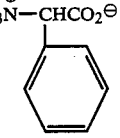

(4) $(CH_3)_2\overset{H}{\underset{\oplus}{N}}-CHCO_2^{\ominus}$

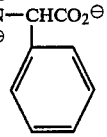

(5) $C_2H_5\overset{H_2}{\underset{\oplus}{N}}-CH_2CO_2^{\ominus}$ (6) $(C_2H_5)_2\overset{H}{\underset{\oplus}{N}}-CH_2CO_2^{\ominus}$ (7) $(C_4H_9)_3\overset{\oplus}{N}CH_2CO_2^{\ominus}$ (8) $HOCH_2CH_2$, $C_4H_9-\overset{\oplus}{N}CH_2CO_2^{\ominus}$, $COCH_2CH_2$ -continued (9) $ClCH_2CH_2$, $H-\overset{\oplus}{N}CH_2CO_2^{\ominus}$, $ClCH_2CH_2$

(10) $(CH_3)_3\overset{\oplus}{N}-CHCO_2^{\ominus}$, Br

(11) $HN=C(CH_3N\,H)-\overset{H_2}{\underset{\oplus}{N}}-CH_2CO_2^{\ominus}$

(12) $NH=C(CH_2=CHCH_2N\,H)-\overset{H_2}{\underset{\oplus}{N}}-CH_2CO_2^{\ominus}$

(13) $CH_3N=C(CH_3N\,H)-\overset{H_2}{\underset{\oplus}{N}}-CH_2CO_2^{\ominus}$

(14) $CH_3N=C(CH_3N\,H)-\overset{H_2}{\underset{\oplus}{N}}-CHCO_2^{\ominus}$

(15) $(C_2H_5)_2\overset{H}{\underset{\oplus}{N}}-CH(CH_2-)CO_2^{\ominus}$

(16) $H\,N=C-\overset{H_2}{\underset{\oplus}{N}}-CH_2CO_2^{\ominus}$, N

(17) $(CH_3)_3\overset{\oplus}{N}-C(H)(HNCCH_3\,O)-CO_2^{\ominus}$

(18) $(CH_3)_3\overset{\oplus}{N}-C(H)(OCH_3)-CO_2^{\ominus}$

(19) $CH_3$, $C=\overset{H_2}{\underset{\oplus}{N}}-CH_2CO_2^{\ominus}$, $N-CH_3$ Examples of compounds of formula (II):

(20) $(CH_3)_6\overset{\oplus}{N}-CH_2CH_2CO_2^{\ominus}$

-continued
(21)
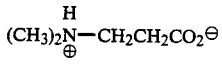
(22)
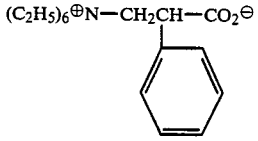
(23)
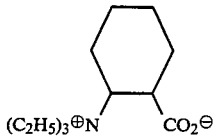
(24)
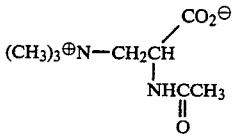
Examples of compounds of formula (III):
(25)
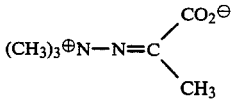
(26)
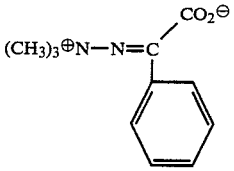
(27)
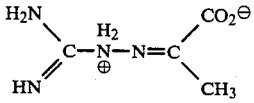
(28)
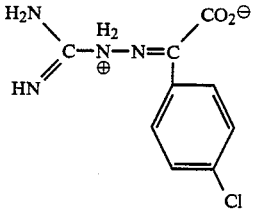
(29)
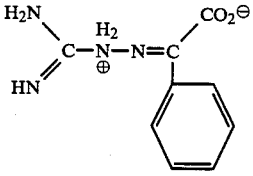
(30)
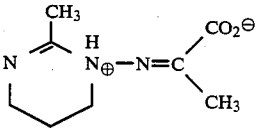
-continued
(31)
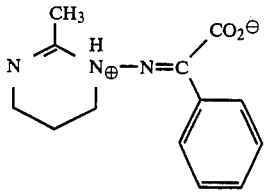
(32)
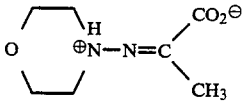
(33)
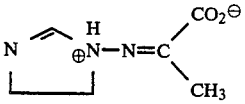
(34)
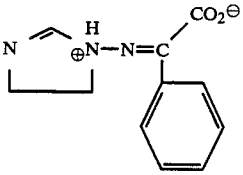
(35)
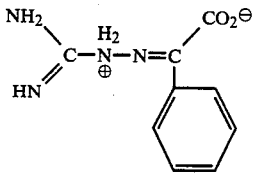
(36)
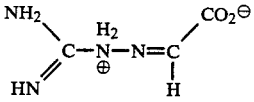
Examples of compounds of formula (IV):
(37)
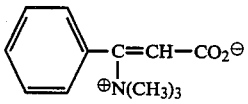
(38)
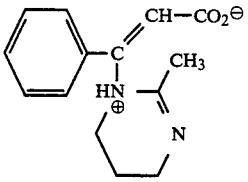
(39)
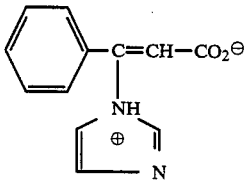

-continued (40)

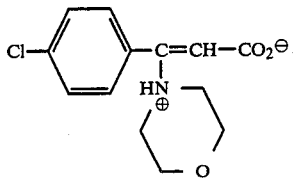

(41)

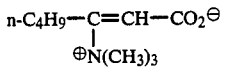

All of the above-described base precursors may easily be synthesized in a conventional manner.

1. Synthesis of compounds of formulae (I) and (II):

For instance, the above exemplified compound No. (1) may be obtained by reacting a starting material (a salt of a quaternarized amino acid corresponding to the intended compound with hydrochloride) with a silver oxide to form a betaine compound. Other base precursors may analogously be synthesized with ease from an amine compound and an α- or β-halo-carboxylic acid. For example, the exemplified compound No. (12) may be obtained from N-allyl-S-methylthiuronium chloride and glycine, according to the method of U.S. Pat. No. 2,592,418 or 2,636,045. Other similar methods for synthesis of said base precursors are also known, for example, as described in *Industrial Chemistry,* Vol. 60, p. 908 (1957) and in Ber., Vol. 35, p. 603, and Vol. 38, p. 167.

2. Synthesis of compounds of formula (III):

Synthesis of above exemplified compound No. (36):

14.8 g of 50%-aqueous solution of glyoxylic acid was gradually added to a suspension comprising 13.6 g of aminoguanidine bicarbonate and 100 ml of water. The resultant mixture was stirred for 30 minutes and then filtered, rinsed with water and dried. The yield of the obtained product was 13 g, and the melting point thereof was from 153° to 155° C.

3. Synthesis of compounds of formula (IV):

Synthesis of above exemplified compound No. (39):

(3-a) Preparation of methyl phenylpropiolate:

Phenylpropiolic acid was prepared according to the method as described in *J. Chem. Soc.,* Vol. 83, p. 1154 Next, 42 ml of thionyl chloride was added to a mixture comprising 42 g of said phenylpropiolic acid and 50 ml of methylene chloride, and gently heated for reflux on a hot-water bath. After the evolution of gas ceased, the reaction mixture was subjected to distillation under a reduced pressure to remove the used solvent and the excess thionyl chloride.

The pale yellow liquid obtained was gradually added to 300 ml of methanol while being cooled with ice. The whole was then left as such for one night, and then the solvent was distilled off under reduced pressure. The remaining liquid was rinsed with water and then dried. The yield of the aimed methyl phenyl propiolate was 44.5 g.

(3-b) Preparation of the final product of compound No. (39):

A mixture comprising 28 g of the above obtained methylphenylpropiolate, 35.7 g of imidazole and 60 ml of dry acetonitrile was heated under reflux for 3 hours. After cooling the acetonitrile was distilled off from the reaction mixture, and 300 ml of water and 200 ml of ethyl acetate were added to the remained residue and well shaken. The separated organic layer was isolated, rinsed with water, dried, and then the solvent was distilled off therefrom under reduced pressure. The obtained residue was purified by means of silica gel chromatography, to obtain 34.2 g of an adduct (cis-trans mixture) which was a colorless viscous liquid. Next, this was dissolved in 50 ml of methanol, and then gradually this was added to 500 ml of 1N-sodium hydroxide aqueous solution while being cooled with ice, and stirred at from 5° to 10° C. until the solution became uniform. After the solution became uniform, this was further stirred for one hour at from 5° to 10° C., and then neutralized with a cold dilute hydrochloric acid solution while cooling with ice, to adjust the pH value of the solution to between 5 and 6. Meanwhile, a pale yellow oil was freed, and gradually crystallized. The formed crystal was filtered out, rinsed with water, and then dried, to obtain said compound No. (39) weighing 24 g.

In the present invention, a heat developable silver halide light-sensitive material may be used as a heat developable light-sensitive material. The silver halide light-sensitive material comprises a support having coated thereon at least one silver halide emulsion layer comprising a silver halide dispersed in a binder. The silver halide light-sensitive material may further have at least one of an interlayer, a filter layer, an antihalation layer, a protective layer, and an image fixing (receiving) layer.

The base precursor of the present invention may be incorporated into any of these layers; however, it is preferably incorporated in a silver halide emulsion layer. When the fixing layer is provided on a different support from that on which the silver halide emulsion layer is coated, the base precursor may be incorporated to this fixing layer. In this case a fixing material having a fixing layer and a heat developable light-sensitive material are used in combination.

The base precursor is incorporated into at least one of above-described layers by dissolving it into water or an organic solvent having a low boiling point (such as methanol) or a high boiling point (such as those disclosed hereinafter as a solvent for a dye providing material), and dissolving or dispersing the thus obtained solution to a coating composition for the layer. The base precursor may also be dispersed in a binder solution directly.

The effect of the base precursor of the present invention is especially remarkable, when used together with a silver halide emulsion as a photographic material.

The amount of the photographic silver halide to be coated in the present invention is suitably 1 mg to 10 g/m$^2$, as calculated on the basis of the silver weight.

The effect of the base precursor of this invention is particularly remarkable when used together with a light-sensitive silver halide emulsion that has been spectrally sensitized. That is, when the precursor is used together with a spectrally sensitized light-sensitive silver halide emulsion, the extent of increasing the image density is particularly high.

The spectral sensitization of silver halide emulsions is performed using methine dyes, etc. Examples of dyes useful for spectral sensitization are shown hereinafter.

The amount of the sensitizing dye is from 0.001 g to 20 g, and preferably from 0.01 g to 2 g per 100 g of silver of the silver halide emulsion.

According to the present invention, silver can be utilized as an image forming substance. Further, various other image forming substances can be employed in various image forming processes.

For instance, couplers capable of forming color images upon reaction with an oxidation product of a developing agent which are used in liquid development processing widely known hitherto can be employed. For example, as magenta couplers, there are 5-pyrazolone couplers, pyrazolobenzimidazole couplers, cyanoacetylcoumarone couplers and open chain acylacetonitrile couplers, etc. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible substances which have a hydrophobic group called a ballast group in the molecule thereof or be polymerized substances. The couplers may be any of the 4-equivalent type and 2-equivalent type to silver ions. Further, they may be colored couplers having a color correction effect or couplers which release a development inhibitor at development processing (so-called DIR couplers).

Further, dyes for forming positive color images by a light-sensitive silver dye bleach processes, for example, those as described in *Research Disclosure,* No. 14433, pages 30–32 (April, 1976), ibid., No. 15227, pages 14–15 (December, 1976) and U.S. Pat. No. 4,235,957, etc., can be employed.

Moreover, leuco dyes as described, for example, in U.S. Pat. Nos. 3,985,565 and 4,022,617, etc., can be used.

Further, dyes to which a nitrogen-containing heterocyclic group have been introduced as described in *Research Disclosure,* No. 16966, pages 54–58 (May, 1978), may be employed.

In addition, dye providing substances which release a mobile dye by utilizing a coupling reaction of a reducing agent oxidized by an oxidation reduction reaction with a silver halide or an organic silver salt at high temperature as described in European Pat. No. 79,056, West German Pat. No. 3,217,853, European Pat. No. 67,455, etc., and dye providing substances which release a mobile dye as a result of an oxidation reduction reaction with a silver halide or an organic silver salt at high temperature as described in European Pat. No. 76,492, West German Pat. No. 3,215,485, European Pat. No. 66,282, Japanese Patent Application Nos. 28928/83 and 26008/83, etc., can be employed.

Preferred dye providing substances which can be employed in these processes can be represented by the following general formula (CI):

$$\text{ti (Dye-X)}_q\text{Y} \qquad \text{(CI)}$$

wherein Dye represents a dye which becomes mobile when it is released from the molecule of the compound represented by the general formula (CI); X represents a simple bond or a connecting group; Y represents a group which releases Dye in correspondence or counter-correspondence to light-sensitive silver salts having a latent image distributed imagewise, the diffusibility of Dye released being different from that of the compound represented by formula (CI) and q represents an integer of 1 or 2.

The dye represented by Dye is preferably a dye having a hydrophilic group. Examples of the dye which can be used include azo dyes, azomethine dyes, anthraquinone dyes, naphthoquinone dyes, styryl dyes, nitro dyes, quinoline dyes, carbonyl dyes and phthalocyanine dyes, etc. These dyes can also be used in the form of having temporarily shorter wavelengths, the color of which is recoverable in the development processing.

More specifically, the dyes as described in European Pat. No. 76,492 can be utilized.

Examples of the connecting group represented by X include —NR— (wherein R represents a hydrogen atom, an alkyl group, or a substituted alkyl group), $—SO_2—$, —CO—, an alkylene group, a substituted alkylene group, a phenylene group, a substituted phenylene group, a naphthylene group, a substituted naphthylene group, —O—, —SO—, or a group derived by combining together two or more of the foregoing groups.

In the following, preferred embodiments of Y in formula (CI) are described in greater detail.

In one embodiment, Y is selected so that the compound represented by the general formula (CI) is a nondiffusible image forming compound which is oxidized as a result of development, thereby undergoing self-cleavage and releasing a diffusible dye.

An example of Y which is effective for compounds of this type is an N-substituted sulfamoyl group. For example, a group represented by formula (CII) is illustrated for Y.

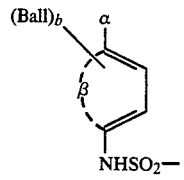

(CII)

wherein $\beta$ represents non-metallic atoms necessary for forming a benzene ring, which may optionally be fused with a carbon ring or a hetero ring to form, for example, a naphthalene ring, a quinoline ring, a 5,6,7,8-tetrahydronaphthalene ring, a chroman ring or the like;

$\alpha$ represents a group of $—OG^{11}$ or $—NHG^{12}$ (wherein $G^{11}$ represents hydrogen or a group which forms a hydroxyl group upon being hydrolyzed, and $G^{12}$ represents hydrogen, an alkyl group containing 1 to 22 carbon atoms or a hydrolyzable group);

Ball represents a ballast group; and b represents an integer of 0, 1 or 2.

Specific examples of this type of Y are described in Japanese Patent Application (OPI) Nos. 33826/73 and 50736/78.

Other examples of Y suited for this type of compound are those represented by the following general formula (CIII):

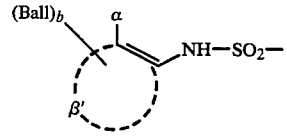

(CIII)

wherein Ball, $\alpha$ and b are the same as defined with (CII), $\beta'$ represents atoms necessary for forming a carbon ring (e.g., a benzene ring which may be fused with another carbon ring or a hetero ring to form a naphthalene ring, quinoline ring, 5,6,7,8-tetrahydronaphthalene ring, chroman ring or the like. Specific examples of this type of Y are described in Japanese Patent Application (OPI) Nos. 113624/76, 12642/81, 16130/81, 4043/82 and 650/82 and U.S. Pat. No. 4,053,312.

Further examples of Y suited for this type of compound are those represented by the following formula (CIV):

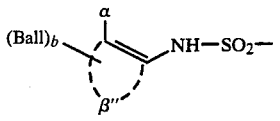

(CIV)

wherein Ball, $\alpha$ and b are the same as defined with the formula (CII), and $\beta''$ represents atoms necessary for forming a hetero ring such as a pyrazole ring, a pyridine ring or the like, said hetero ring being optionally bound to a carbon ring or a hetero ring. Specific examples of this type of Y are described in Japanese Patent Application (OPI) No. 104343/76.

Still further examples of Y suited for this type of compound are those represented by the following formula (CV):

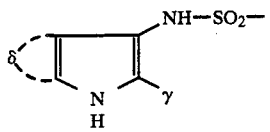

(CV)

wherein $\gamma$ preferably represents hydrogen, a substituted or unsubstituted alkyl, aryl or heterocyclic group, or —CO—$G^{21}$; $G^{21}$ represents —$OG^{22}$, —$SG^{22}$ or

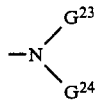

(wherein $G^{22}$ represents hydrogen, an alkyl group, a cycloalkyl group or an aryl group, $G^{23}$ is the same as defined for said $G^{22}$, or $G^{23}$ represents an acyl group derived from an aliphatic or aromatic carboxylic or sulfonic acid, and $G^{24}$ represents hydrogen or an unsubstituted or substituted alkyl group); and $\delta$ represents a residue necessary for completing a fused benzene ring.

Specific examples of this type of Y are described in Japanese Patent Application (OPI) Nos. 104343/76, 46730/78, 130122/79 and 85055/82.

Still further examples of Y suited for this type of compound are those represented by the formula (CVI):

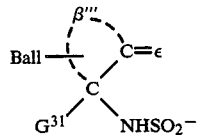

(CVI)

wherein Ball is the same as defined with the formula (CII); $\epsilon$ represents an oxygen atom or =$NG^{32}$ (wherein $G^{32}$ represents hydroxyl or an optionally substituted amino group) (examples of $H_2N$—$G^{32}$ to be used for forming the group of =$NG^{32}$ including hydroxylamine, hydrazines, semicarbazides, thiosemicarbazides, etc.); $\beta'''$ represents a saturated or unsaturated nonaromatic 5-, 6- or 7-membered hydrocarbon ring; and $G^{31}$ represents hydrogen or a halogen atom (e.g., a fluorine atom, a chlorine atom, a bromine atom, etc.).

Specific examples of this type of Y are described in Japanese Patent Application (OPI) Nos. 3819/78 and 48534/79.

Other examples of Y of this type of compound are described in Japanese Patent Publication Nos. 32129/73, 39165/73, Japanese Patent Application (OPI) No. 64436/74, U.S. Pat. No. 3,443,934, etc.

Still further examples of Y are those represented by the following formula (CVII):

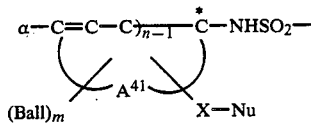

(CVII)

wherein $\alpha$ represents $OR^{41}$ or $NHR^{42}$; $R^{41}$ represents hydrogen or a hydrolyzable component; $R^{42}$ represents hydrogen, or an alkyl group containing 1 to 50 carbon atoms; $A^{41}$ represents atoms necessary for forming an aromatic ring; Ball represents an organic immobile group existing on the aromatic ring, with Ball's being the same or different from each other; m represents an integer of 1 or 2; X represents a divalent organic group having 1 to 8 atoms, with the nucleophilic group (Nu) and an electrophilic center (asterisked carbon atom) formed by oxidation forming a 5- to 12-membered ring; Nu represents a nucleophilic group; n represents an integer of 1 or 2; and $\alpha$ may be the same as defined with the above described formula (CII). Specific examples of this type of Y are described in Japanese Patent Application (OPI) No. 20735/82.

As still further type of examples represented by the formula (CI), there are dye providing nondiffusible substances which release a diffusible dye in the presence of a base as a result of self cyclization or the like but which, when reacted with an oxidation product of a developing agent, substantially never release the dye.

Examples of Y effective for this type of compound are those which are represented by the formula (CVIII):

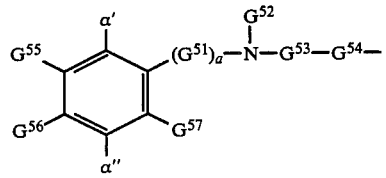

(CVIII)

wherein $\alpha'$ represents an oxidizable nucleophilic group (e.g., a hydroxy group, a primary or secondary amino group, a hydroxyamino group, a sulfonamido group or the like) or a precursor thereof;

$\alpha''$ represents a dialkylamino group or an optional group defined for $\alpha'$;

$G^{51}$ represents an alkylene group having 1 to 3 carbon atoms;

a represents 0 or 1;

$G^{52}$ represents a substituted or unsubstituted alkyl group having 1 to 40 carbon atoms or a substituted or unsubstituted aryl group having 6 to 40 carbon atoms;

$G^{53}$ represents an electrophilic group such as —CO— or —CS—;

$G^{54}$ represents an oxygen atom, a sulfur atom, a selenium atom, a nitrogen atom or the like and, when $G^{54}$ represents a nitrogen atom, it has hydrogen or may be substituted by an alkyl or substituted alkyl group having 1 to 10 carbon atoms or an aromatic residue having 6 to 20 carbon atoms; and $G^{55}$, $G^{56}$ and $G^{57}$ each represents hydrogen, a halogen atom, a carbonyl group, a sulfamyl group, a sulfonamido group, an alkyloxy group having 1 to 40 carbon atoms or an optional group defined for $G^{52}$, $G^{55}$ and $G^{56}$ may form a 5- to 7-membered ring, and $G^{56}$ may represent $$-(G^{51})_a-\overset{\overset{\displaystyle G^{52}}{|}}{N}-G^{53}-G^{54}-,$$

with the proviso that at least one of $G^{52}$, $G^{55}$, $G^{56}$ and $G^{57}$ represents a ballast group. Specific examples of this type of Y are described in Japanese Patent Application (OPI) No. 63618/76.

Further examples of Y suited for this type of compound are those which are represented by the following general formulae (CIX) and (CX):

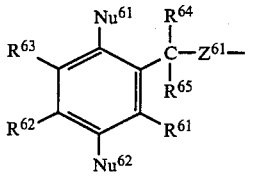

(CIX)

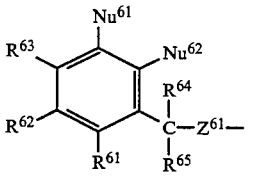

(CX)

wherein $Nu^{61}$ and $Nu^{62}$, which may be the same or different, each represents a nucleophilic group or a precursor thereof; $Z^{61}$ represents a divalent atom group which is electrically negative with respect to the carbon atom substituted by $R^{64}$ and $R^{65}$; $R^{61}$, $R^{62}$ and $R^{63}$ each represents hydrogen, a halogen atom, an alkyl group, an alkoxy group or an acylamino group or, when located at adjacent positions on the ring, $R^{61}$ and $R^{62}$ may form a fused ring together with the rest of the molecule, or $R^{62}$ and $R^{63}$ may form a fused ring together with the rest of the molecule; $R^{64}$ and $R^{65}$, which may be the same or different, each represents hydrogen, a hydrocarbon group or a substituted hydrocarbon group; with at least one of the substituents, $R^{61}$, $R^{62}$, $R^{63}$, $R^{64}$ and $R^{65}$ having a ballast group, Ball, of an enough size so as to render the above described compounds immobile. Specific examples of this type of Y are described in Japanese Patent Application (OPI) Nos. 69033/78 and 130927/79.

Further examples of Y suited for this type of compound are those which are represented by the formula (CXI):

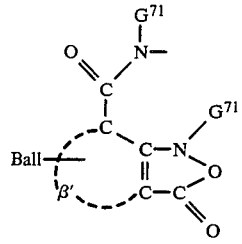

(CXI)

wherein Ball and $\beta'$ are the same as defined for those in formula (CIII), and $G^{71}$ represents an alkyl group (including a substituted alkyl group). Specific examples of this type of Y are described in Japanese Patent Application (OPI) Nos. 111628/74 and 4819/77.

As different type of compound represented by the general formula (CI), there are illustrated dye providing nondiffusible substances which themselves do not release any dye but, upon reaction with a reducing agent, release a dye. With these compounds, compounds which mediate the redox reaction (called electron donors) are preferably used in combination.

Examples of Y effective for this type of compound are those represented by the formula (CXII):

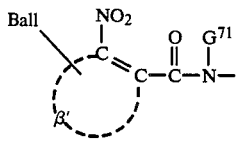

(CXII)

wherein Ball and $\beta'$ are the same as defined for those in the general formula (CIII), and $G^{71}$ represents an alkyl group (including a substituted alkyl group). Specific examples of this type of Y are described in Japanese Patent Application (OPI) Nos. 35533/78 and 110827/78.

Further examples of Y suited for this type of compound are those which are represented by (CXIII):

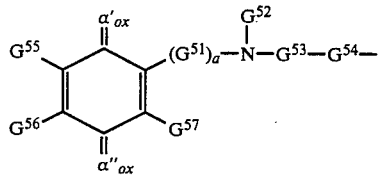

(CXIII)

wherein $\alpha'_{ox}$ and $\alpha''_{ox}$ represent groups capable of giving $\alpha'$ and $\alpha''$, respectively, upon reduction, and $\alpha'$, $\alpha''$, $G^{51}$ $G^{52}$, $G^{53}$, $G^{54}$, $G^{55}$, $G^{56}$, $G^{57}$ and a are the same as defined with respect to formula (CVIII). Specific examples of Y described above are described in Japanese Patent Application (OPI) No. 110827/78, U.S. Pat. Nos. 4,356,249 and 4,358,525.

Further examples of Y suited for this type of compound are those which are represented by the formulae (CXIV-A) and (CXIV-B):

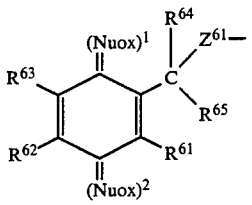

(CXIV-A)

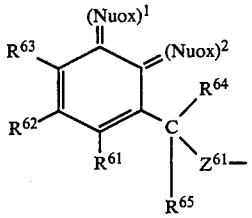

(CXIV-B)

wherein $(Nuox)^1$ and $(Nuox)^2$, which may be the same or different, each represents an oxidized nucleophilic group, and other notations are the same as defined with respect to the formulae (CIX) and (CX). Specific examples of this type of Y are described in Japanese Patent Application (OPI) Nos. 130927/79 and 164342/81.

The publicly known documents having been referred to with respect to (CXII), (CXIII), (CXIV-A) and (CXIV-B) describe electron donors to be used in combination.

As still further different type of compound represented by the general formula (CI), there are illustrated LDA compounds (Linked Donor Acceptor Compounds). These compounds are dye providing nondiffusible substances which cause donor-acceptor reaction in the presence of a base to release a diffusible dye but, upon reaction with an oxidation product of a developing agent, they substantially do not release the dye any more.

Examples of Y effective for this type of compound are those represented by the formula (CXV) (specific examples thereof being described in Japanese Patent Application (OPI) No. 60289/83):

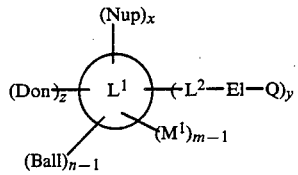

(CXV)

wherein n, x, y and z each represents 1 or 2, m represents an integer of 1 or more; Don represents a group containing an electron donor or its precursor moiety; $L^1$ represents an organic group linking Nup to $—L^2—El—Q$ or Don; Nup represents a precursor of a nucleophilic group; E2 represents an electrophilic center; Q represents a divalent group; Ball represents a ballast group; $L^2$ represents a linking group; and $M^1$ represents an optional substituent.

The ballast group is an organic ballast group which can render the dye providing substance nondiffusible, and is preferably a group containing a $C_{8-32}$ hydrophobic group. Such organic ballast group is bound to the dye providing substance directly or through a linking group (e.g., an imino bond, an ether bond, a thioether bond, a carbonamido bond, a sulfonamido bond, a ureido bond, an ester bond, an imido bond, a carbamoyl bond, a sulfamoyl bond, etc., and combination thereof).

Two or more kinds of the dye providing substances can be employed together. In such a case two or more kinds of the dye providing substances may be used together in order to provide the same hue or in order to reproduce black color.

The dye providing redox compound used in the present invention can be introduced into a layer of the light-sensitive material by known methods such as the method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic colloid. For this purpose, the surface active agents illustrated in other part of the specification can be used.

In the present invention, if necessary, a reducing agent may be used. The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different from each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* The Fourth Edition, Chapter 5, pages 149–169.

In the particularly preferred embodiment of the present invention, an organic silver salt oxidizing agent is used together. The organic silver salt oxidizing agent is a silver salt which forms a silver image by reacting with the above described image forming substance or a reducing agent coexisting, if necessary, with the image forming substance, when it is heated to a temperature of above 80° C. and, preferably, above 100° C. in the presence of exposed silver halide. By coexisting the organic silver salt oxidizing agent, the light-sensitive material which provides higher color density can be obtained.

Examples of such organic silver salt oxidizing agents include those described in U.S. Pat. No. 4,500,626.

A silver salt of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

The photosensitive material of the present invention can contain a toning agent as occasion arises. Effective toning agents are 1,2,4-triazoles, 1H-tetrazoles, thiouracils, 1,3,4-thiadiazoles, and like compounds. Examples of preferred toning agents include 5-amino-1,3,4-thiadiazole-2-thiol, 3-mercapto-1,2,4-triazole, bis(dimethylcarbamyl)disulfide, 6-methylthiouracil, 1-phenyl-2-tetrazoline-5-thione, and the like. Particularly effective toning agents are compounds which can impart a black color tone to images.

The content of such a toning agent as described above, though depending upon the kind of a heat developable photosensitive material used, processing conditions, desired images and various other factors, generally ranges from about 0.001 to 0.1 mol per mol of silver in the photosensitive material.

The above described bases or base precursors can be used not only for the acceleration of dye release but also for other purposes such as the control of a pH value.

The above described various ingredients to constitute a heat developable photosensitive material can be arranged in arbitrary positions, if desired. For instance, one or more of the ingredients can be incorporated in one or more of the constituent layers of a photosensitive material, if desired. In some cases, it is desired that particular portions of reducing agent, image stabilizing agent and/or other additives should be distributed in a protective layer. As a result of the distribution in the above described manner, migration of additives among constituent layers of a heat developable photosensitive material can be reduced. Therefore, such distribution of additives is of advantage to some cases.

The heat developable photosensitive materials of the present invention are effective in forming both negative and positive images. The negative or positive image can be formed depending mainly on the type of the light-sensitive silver halide. For instance, in order to produce direct positive images, internal image type silver halide emulsions described in U.S. Pat. Nos. 2,592,250, 3,206,313, 3,367,778 and 3,447,927, or mixtures of surface image type silver halide emulsions with internal image type silver halide emulsions as described in U.S. Pat. No. 2,996,382 can be used.

Various means of exposure can be used in the present invention. Latent images are obtained by imagewise exposure by radiant rays including visible rays. Generally, light sources used for conventional color prints can be used, example of which include tungsten lamps, mercury lamps, halogen lamps such as iodine lamps, xenon lamps, laser light sources, CRT light sources, fluorescent tubes and light emitting diodes, etc.

In the present invention, after the heat developable color photographic material is exposed to light, the resulting latent image can be developed by heating the whole material to a suitably elevated temperatures. A higher temperature or lower temperature can be utilized to prolong or shorten the heating time, if it is within the above described temperature range.

As the heating means, a simple heat plate, iron, heat roller, heat generator utilizing carbon or titanium white, etc., or analogues thereof may be used.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Examples of useful sensitizing dyes are described in, for example, German Pat. No. 929,080; U.S. Pat. Nos. 2,493,748; 2,503,776; 2,519,001; 2,912,329; 3,656,959; 3,672,897; 3,694,217; 4,025,349; 4,046,572; U.K. Pat. No. 1,242,588; Japanese Patent Publication Nos. 14,030/69 and 24,844/77.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material and the dye fixing material employed, if desired, according to the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used alone or as a combination thereof.

The transfer of dyes from the light-sensitive layer to the dye fixing layer can be carried out using a dye transfer assistant.

The dye transfer assistants suitably used in a process wherein it is supplied from the outside include water and an aqueous solution containing sodium hydroxide, potassium hydroxide or an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be used by wetting the image receiving layer with the transfer assistant.

When the dye transfer assistant is incorporated into the light-sensitive material or the dye fixing material, it is not necessary to supply the transfer assistant from the outside. In this case, the above described dye transfer assistant may be incorporated into the material in the form of water of crystallization or microcapsules or as a precursor which releases a solvent at a high temperature.

More preferred process is a process wherein a hydrophilic thermal solvent which is solid at an ambient temperature and melts at a high temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the interlayer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

Other compounds which can be used in the photosensitive material of the present invention, for example, sulfamide derivatives, cationic compounds containing a pyridinium group, surface active agents having polyethylene oxide chains, sensitizing dye, antihalation and anti-irradiation dyes, hardeners, mordants and so on, are those described in U.S. Pat. Nos. 4,500,626, 4,478,927, 4,463,079, and Japanese Patent Application Nos. 28928/83 (corresponding to U.S. patent application Ser. No. 582,655, filed on Feb. 23, 1984) and U.S. Pat. No. 4,503,137. Methods for the exposure and so on cited in the above described patents can be employed in the present invention also.

Now, the present invention will be explained in greater detail by reference to the following examples, which, however, are not intended to be interpreted as limiting the scope of the present invention.

EXAMPLE 1

Preparation of Silver Iodobromide Emulsion

Gelatin (40 g) and KBr (26 g) were dissolved in water (3,000 ml). The solution was agitated at 50° C. A solution obtained by dissolving silver nitrate (34 g) in water (200 ml), and a solution (200 ml) obtained by dissolving dye I (0.02 g) shown hereinafter to methanol (300 cc) were simultaneously added to the KBr solution over a period of 10 minutes. To this solution, a solution of KI (3.3 g) in water (100 ml) was added over a period of 2 minutes. The pH of the thus prepared silver iodobromide emulsion was adjusted to precipitate the emulsion and the excess salt was then filtered out. The pH of the emulsion was adjusted to 6.0 to obtain a silver iodobromide emulsion (yield: 400 g).

Preparation of Coupler Dispersion in Gelatin

2-Dodecylcarbamoyl-1-naphthol (dye providing material (5 g), succinic acid-2-ethylhexyl ester sodium sulfonate (0.5 g) and tricresyl phosphate (TCP) (2.5 g) were dissolved in ethyl acetate (30 ml). The resulting solution was mixed with a 10 wt% gelatin solution (100 g) under agitation, and, the mixture was dispersed using a homogenizer for 10 minutes at 10,000 rpm.

Preparation of Light-Sensitive Material

A coating liquid having the composition indicated below was applied to a polyethylene terephthalate film base to give a wet thickness of 60 μm and then dried to prepare a light-sensitive material.

(a) Silver iodobromide emulsion: 10 g
(b) Coupler dispersion in gelatin: 3.5 g
(c) Solution of base precursor (11) of the present invention: 0.11 g
(d) Gelatin (10 wt% aq. sol.): 5 g
(e) Solution of 0.2 g of 2,6-dichloro-p-aminophenol dissolved in 17 ml of water The light-sensitive material thus prepared was imagewise exposed using a tungsten lamp (2,000 lux) for 5 seconds. Then, the exposed material was heated uniforming on a heat block (150° C., 20 sec) to provide a negative cyan dye image. The image density was measured with a Macbeth transmission densitometer (Model TD-504): Dmin was 0.19 and Dmax was 2.12.

The above result indicates that the base precursor according to the present invention provides a high density.

Dye I

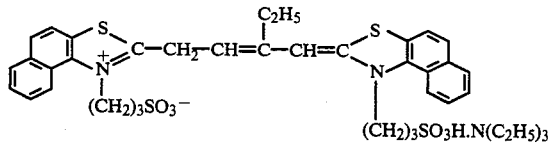

EXAMPLE 2

In this example, a silver iodobromide emulsion of the same type as used in Example 1, and a dispersion of dye releasing material prepared as follows were used.

Preparation of Dispersion of Dye Releasing Material

Five grams of a dye releasing material (2) and 0.5 g of surfactant i.e. succinic acid-2-ethylhexyl ester sodium sulfonate and 5 g of tricresyl phosphate (TCP) were dissolved in 30 ml of ethyl acetate under heating at about 60° C. The resulting solution was mixed with a 10 wt% gelatin solution (100 g) under agitation, and the resulting mixture was dispersed under a homogenizer for 10 minutes at 10,000 rpm.

Preparation of Light-Sensitive Material (a) Light-sensitive silver iodobromide emulsion (as shown in Example 1): 25 g
(b) Dispersion of dye releasing material (2): 33 g
(c) 5 wt% Aqueous solution of the following compound: 10 ml

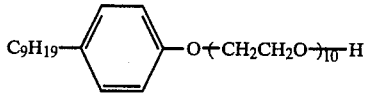

(d) 10 wt % Aqueous solution of the following compound: 4 ml $H_2NSO_2N(CH_3)_2$ (e) Base precursor (11) of the present invention: 1.1 g
(f) Water: 20 ml The above components of (a)–(f) were mixed and dissolved under heating. The resulting solution was applied onto a polyethylene terephthalate film base to give a wet thickness of 30 μm and then dried to provide a light-sensitive material. This material was imagewise exposed using a tungsten lamp (2,000 lux) for 10 seconds and heated uniformly on a heat block (150° C.) for 20 seconds to provide Sample A.

Comparative Sample B was prepared by following the same procedure as above except that 1.8 g of guanidinetrichloroacetic acid was used in place of the compound of this invention of (e) in Sample A, and these samples were processed by the same manner as above.

Preparation of Image-Receiving Material having Image-Receiving Layer

Ten grams of poly(methyl acrylate-co-N,N,N-trimethyl-N-vinyl-benzylammonium chloride) (molar ratio of methyl acrylate to vinyl benzyl ammonium chloride is 1:1) was dissolved in water (200 ml), and the solution was mixed uniformly with 10 wt% lime-treated gelatin (100 g). The resulting mixture was uniformly coating onto a paper base laminated with $TiO_2$ dispersed polyethylene, thereby forming an image-receiving layer of a uniform wet thickness of 90 μm. The layer was dried to provide an image-receiving material.

The image receiving material was dipped in water and recovered therefrom. Samples A and B of the light-sensitive material heated were superimposed on each sample of image-receiving material in such a manner that each of the light-sensitive layers was in contact with the image-receiving layer, respectively.

After heating on a heat block (80° C.) for 6 seconds, each image-receiving material was peeled from each light-sensitive material. A negative magenta image was formed on each image-receiving material. The density of each negative image was measured with a Machbeth (RD-519) reflection densitometer. The results were as follows.

| Sample No. | Dmax | Dmin |
|---|---|---|
| A (Present Invention) | 2.06 | 0.15 |
| B (Comparative) | 2.14 | 0.58 |

The above results show that the base precursor according to the present invention gives high maximum and low minimum densities.

Samples A and B were allowed to stand at 60° C. for 2 days, and treated as above. The Dmin and Dmax of the image of sample A were 0.23 and 2.02, but fog occurred thoughout the surface of sample B. Thus, the sample of the present invention has an improved storage stability.

EXAMPLE 3

The procedure of Example 2 was repeated except that the base precursors shown in the following Table 1 were used. The results are also shown in the same table.

TABLE 1

| Sample No. | Base Precursor | Amount (g) | Fresh Image Density Dmax | Fresh Image Density Dmin | Thermo-Preserved at 60° C. for 2 days Image Density Dmax | Thermo-Preserved at 60° C. for 2 days Image Density Dmin |
|---|---|---|---|---|---|---|
| C | Compound 1 | 1.0 | 2.13 | 0.23 | 2.03 | 0.28 |
| D | Compound 20 | 1.1 | 1.86 | 0.11 | 1.85 | 0.13 |
| E | Compound 36 | 1.1 | 2.05 | 0.13 | 2.02 | 0.18 |

TABLE 1-continued

| Sample No. | Base Precursor | Amount (g) | Fresh Image Density Dmax | Fresh Image Density Dmin | Thermo-Preserved at 60° C. for 2 days Image Density Dmax | Thermo-Preserved at 60° C. for 2 days Image Density Dmin |
|---|---|---|---|---|---|---|
| F | Compound 37 | 1.1 | 2.16 | 0.25 | 2.10 | 0.29 |

The above results show that base precursors according to the present invention give high maximum densities and low minimum densities.

EXAMPLE 4

In this example, an organic silver salt oxidizing agent was used.

Preparation of Silver Benzotriazole Emulsion

Gelatin (28 g) and benzotriazole (13.2 g) were dissolved in water (3,000 ml). The resulting solution was agitated at 40° C. To this solution, a solution having silver nitrate (17 g) dissolved in water (100 ml) was added over a period of 2 minutes.

The resulting benzotriazole silver emulsion was pH-adjusted to precipitate, and the excess salt was filtered out. The emulsion was adjusted to a pH of 6.0, thereby providing a silver benzotriazole emulsion (yield: 400 g).

Using this silver benzotriazole emulsion, a light-sensitive coating composition was prepared from the following formulation.

(a) Silver iodobromide emulsion (as prepared in Example 1): 20 g (b) Silver benzotriazole emulsion: 10 g (c) Dispersion of dye releasing material (as prepared in Example 2): 33 g (d) 5% Aqueous solution of the following compound: 10 ml

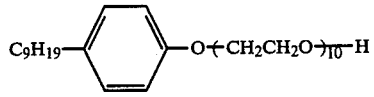

(e) 10% Aqueous solution of the following compound: 4 ml $H_2NSO_2N(CH_3)_2$ (f) Base precursor (11) of the present invention: 1.2 g (g) Gelatin dispersion of the acid precursor shown below: 8 ml (h) Water: 12 ml The gelatin dispersion of the acid precursor of the aforesaid component (g) was prepared as follows.

To 100 g of 1% aqueous solution of gelatin was added 10 g of the compound shown below and the compound was pulverized for 10 minutes in a mill using 100 g of glass beads having a mean particle size of about 0.6 mm. By separating the glass baads by filtration, a gelatin dispersion of the acid precursor was obtained.

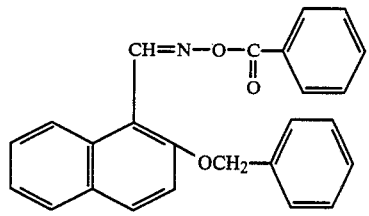

Above components (a) to (h) were mixed and by following the same procedure as in Example 2 using the mixture, a sample was prepared and processed as in Example 2. Comparative Sample was also prepared and processed by following Example 2. The results thus obtained are shown below.

| Sample | Dmax | Dmin |
|---|---|---|
| Present Invention | 2.04 | 0.18 |
| Comparison | 2.33 | 0.61 |

From the results, it can be seen that the sample of this invention containing the base precursor in this invention give both the high maximum density and the low minimum density.

Furthermore, after storing samples for 2 days at 60° C., and the processing in the same manner as above and the results showed that the minimum density and the maximum density of the sample of the present invention were 0.20 and 2.03, respectively, while Comparison Sample was overall fogged. Thus, it can be seen that the sample of this invention shows a good storage stability.

EXAMPLE 5

Preparation of Silver Benzotriazole Emulsion Containing Light-Sensitive Silver Bromide Benzotriazole (6.5 g) and gelatin (10 g) were dissolved in water (1,000 ml). The resulting solution was agitated at 50° C. To this solution, a solution of silver nitrate (8.5 g) dissolved in water (100 ml) was added over a period of 2 minutes.

Then, a solution of potassium bromide (1.2 g) dissolved in water (50 ml) was added to the above-obtained solution over a period of 2 minutes. The thus prepared emulsion was pH-adjusted to precipitate, and the excess salt was filtered out. The emulsion was adjusted to a pH of 6.0, thereby providing a silver benzotriazole emulsion (yield: 200 g).

Preparation of Gelatin Dispersion of Dye Releasing Material

Ten grams of a dye releasing material of the following formula:

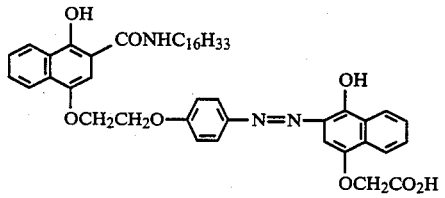

and 0.5 g of a surfactant i.e., succinic acid-2-ethylhexyl ester sodium sulfate, and 4 g of tricresyl phosphate (TCP) were dissolved in 20 ml of cyclohexanone under heating at about 60° C., thereby producing a uniform solution. This solution was mixed with a 10 wt% solution of lime-treated gelatin (100 g) under agitation, and the mixture was dispersed with homogenizer for 10 minutes at 10,000 rpm.

Preparation of Light-Sensitive Coating Composition (a) Silver benzotriazole emulsion containing light-sensitive silver bromide: 10 g
(b) Dispersion of dye releasing material: 3.5 g
(c) Base precursor (11) of the present invention: 0.11 g
(d) Gelatin (10 wt% aq. sol.): 5 g
(e) Solution having 2,6-dichloro-4-aminophenol (200 ml) dissolved in methanol: (4 ml)

The above components of (a)-(e) were mixed and dissolved under heating. The resulting solution was applied to a polyethylene terephthalate film base (180 μm thick) to form a light-sensitive layer having a wet thickness of 30 μm. The resulting web was dried and imagewise exposed using a tungsten lamp (2,000 lux) for 5 seconds and subsequently heated uniformly on a heat block (150° C.) for 20 seconds.

The heated sample of light-sensitive material was processed as in Example 2 to provide a negative magenta image on the image-receiving material. Measurement with a Macbeth reflection densitometer (Model TD-519) showed that the negative image had Dmax 2.09 and Dmin 0.16.

Thus it was found that the compound of the present invention provides excellent effects.

EXAMPLE 6

Preparation of Gelatin Dispersion of Dye Releasing Material

Five grams of reducible dye releasing materials of

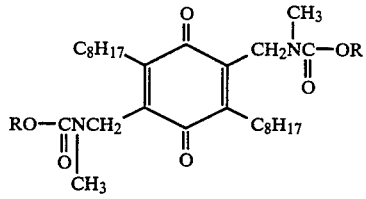

wherein R represents

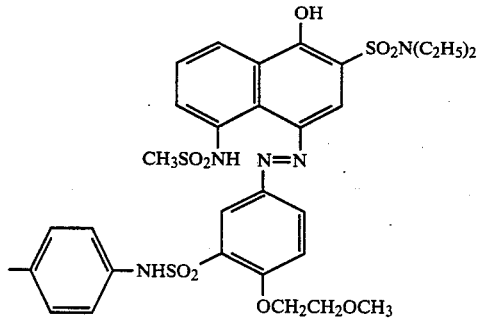

four grams of the electron donor having the following formula:

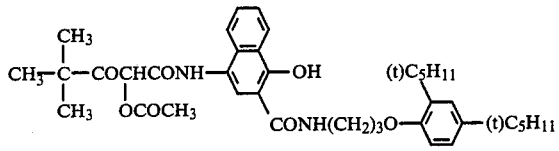

and 0.5 g of succinic acid-2-ethylhexyl ester sodium sulfate, and 10 g of tricresyl phosphate (TCP) were dissolved in 20 ml of cyclohexanone under heating at about 60° C. This solution was mixed with 100 g of a 10 wt% solution of gelatin under agitation, and the mixture was dispersed with homogenizer for 10 minutes at 10,000 rpm.

Preparation of Light-Sensitive Coating Composition (a) Silver benzotriazole emulsion containing light-sensitive silver bromide (obtained in Example 5): 10 g (b) Dispersion of dye releasing material (obtained in this Example): 3.5 g (c) Base precursor (11) of the present invention: 0.16 g (d) 5% Aqueous solution of the following compound: 1.5 ml

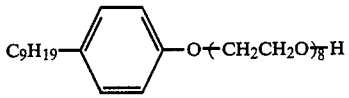

To the above components of (a)–(d) were added 4 ml of water, mixed and dissolved under heating. The resulting solution was applied to a polyethylene terephthalate film base to form a light-sensitive layer having a wet thickness of 30 μm. The resulting web was dried and imagewise exposed using a tungsten lamp (2,000 lux) for 10 seconds and subsequently heated uniformly on a heat block (140° C.) for 40 seconds.

The heated sample of light-sensitive material was superimposed on an image-receiving material prepared in Example 2 previously impregnated with water, so that coated layers are contacted to each other and subsequently processed as in Example 2 to provide a positive magenta image on the image-receiving material. Measurement with Macbeth reflection densitometer (Model-519) using green light showed that the image had Dmax 2.03 and Dmin 0.13.

Thus it was found that the base precursor of the present invention provides excellent effects.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising a support and formed thereon a heat developable light-sensitive layer, wherein said light-sensitive material contains at least one compound selected from the group consisting of compounds represented by formulae (I), (II), and (III) and (IV) as a base precursor which decarboxylates upon heat development to release a basic component

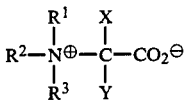

(I)

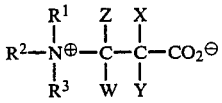

(II)

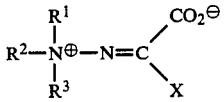

(III)

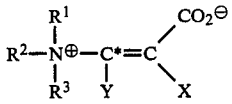

(IV)

wherein $R^1$, $R^2$ and $R^3$ each independently represents a hydrogen atom, an alkyl group, a substituted alkyl group, a cycloalkyl group, an alkenyl group, an alkynyl group, an aryl group, a substituted aryl group, an aralkyl group, a substituted aralkyl group, an imino group represented by the formula

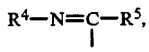

or an amidino group represented by the formula

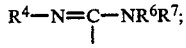

wherein $R^4$ through $R^7$ each independently represents a substituent selected from an alkyl group, a substituted alkyl group, a cycloalkyl group, an alkenyl group, an aryl group, and an aralkyl group, or two of said substituents $R^1$ through $R^7$ together form a ring; p1 W, X, Y and Z each independently represents a hydrogen atom, an alkyl group, a substituted alkyl group, a cycloalkyl group, an alkenyl group, an alkynyl group, an aryl group, a substituted aryl group, an alkoxy group, an aryloxy group, an aralkyl group, a substituted aralkyl group, an alkylcarbonylamino group, an arylcarbonylamino group, a halogen atom, an alkylthio group, an arylthio group, an alkylcarbonyloxy group, an arylcarbonyloxy group, a cyano group, an alkylcarbonyl group, an arylcarbonyl group, an alkylsulfinyl group, an arylsulfinyl group, a carbamoyl group, a substituted carbamoyl group, a sulfamoyl group, a substituted sulfamoyl group, an ureido group, a substituted ureido group, a sulfamoylamino group, a substituted sulfamoylamino group, an alkylsulfonyl group, an arylsulfonyl group, an alkylsulfonylamino group, an arylsulfonylamino group, an alkoxycarbonyl group, an alkoxycarbonylamino group, an aryloxycarbonyl group, an aryloxycarbonylamino group, a heterocyclic ring, a substituted heterocyclic ring, or said X and Z together form a ring.

2. A heat-developable light-sensitive material as in claim 1, wherein the substituents of $R^1$ through $R^7$, W, X, Y and Z are selected from the group consisting of an alkyl group, an alkenyl group, an alkynyl group, an aryl group, and an aralkyl group.

3. A heat-developable light-sensitive material as in claim 1, wherein said base precursor is incorporated in an amount of from 0.01 to 50% by weight based on the total weight of the dry light-sensitive layer.

4. A heat-developable light-sensitive material as in claim 1, wherein said heat developable light-sensitive layer comprises a silver halide emulsion layer.

5. A heat-developable light-sensitive material as in claim 4, wherein said light-sensitive material contains an organic silver salt.

6. A heat-developable light-sensitive material as in claim 5, wherein said organic silver salt is able to form a silver image when it is heated at 80° C. or higher in the presence of an exposed silver halide.

7. A heat-developable light-sensitive material as in claim 4, wherein said silver halide emulsion contains a sensitizing dye.

8. A heat-developable light-sensitive material as in claim 7, wherein the amount of the sensitizing dye is from 0.001 to 20 g per 100 g of silver of the silver halide emulsion.

9. A heat-developable light-sensitive material as in claim 4, wherein the light-sensitive material contains a dye providing material which releases or produces a mobile dye corresponding to or reversely corresponding to a reduction reaction of a silver halide through a reducing agent as an image forming material.

10. A heat developable light-sensitive material as in claim 4, wherein the light-sensitive material contains at least one image forming material selected from the group consisting of a coupler, a dye which is able to form positive color images by a photographic silver dye bleaching process, a dye having introduced therein a nitrogen-containing heterocyclic ring group, a dye-providing material which releases a mobile dye by a coupling reaction with a reducing agent which is oxidized by an oxidation reduction reaction with a silver halide or an organic silver salt upon heat development, a non-diffusible image-forming compound which causes self ring closure in the presence of a base to release a diffusible dye, but does not release the dye when the compound reacts with the oxidation product of a developing agent, and a non-diffusible image-forming compound which does not release a dye by itself but releases a dye when the compound reacts with a reducing agent, and a linked donor acceptor compound which is a non-diffusible image-forming compound and causes a donor-acceptor reaction in the presence of a a base to release a diffusible dye, but does not substantially release the dye when the compound reacts with the oxidation product of a developing agent.

11. A heat-developable light-sensitive material as in claim 4, wherein the light-sensitive material contains at least one image forming material selected from the group consisting of a coupler, a dye which is able to form positive color images by a photographic silver-dye-bleach process, a dye having introduced therein a nitrogen-containing heterocyclic ring group, a dye-providing material which releases a mobile dye by a coupling reaction with a reducing agent which is oxidized by an oxidation reduction reaction with a silver halide or an organic silver salt upon heat development, a dye-providing material which releases a mobile dye as a result of an oxidation-reduction reaction with silver halide or an organic silver salt upon heat development, a non-diffusible image-forming compound which causes self ring closure in the presence of a base to release a diffusible dye, but does not release the dye when the compound reacts with the oxidation product of a developing agent, a non-diffusible image-forming compound which does not release a dye by itself but releases a dye when the compound reacts with a reducing agent, and a linked donor-acceptor compound which is a non-diffusible image-forming compound and causes a donor-acceptor reaction in the presence of a base to release a diffusible dye, but does not substantially release the dye when the compound reacts with the oxidation product of a developing agent.

12. A heat-developable light-sensitive material as in claim 4, wherein the light-sensitive material further comprises at least one of an interlayer, a filter layer, an antihalation layer, a protective layer, and an image fixing layer provided on the support.

13. A heat-developable light-sensitive material as in claim 4, wherein said base precursor is incorporated in the silver halide emulsion layer.

14. A heat-developable light-sensitive material as in claim 4, wherein the light-sensitive material further comprises an image fixing layer provided on a support other than the support on which the light-sensitive layer is formed, and said base precursor is incorporated in the image fixing layer.

15. A heat-developable light-sensitive material as in claim 1, wherein the total carbon atom number of said compound is from 3 to 36.

16. A method for producing an image, which comprises image-wise exposing and heat developing a heat developable light-sensitive material comprising a support and formed thereon a heat developable light-sensitive layer, said light-sensitive material contains at least one compound selected from the group consisting of compounds represented by formulae (I), (II), (III) and (IV) as a base precursor which decarboxylates upon heat development to release a basic component

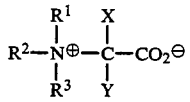
(I)

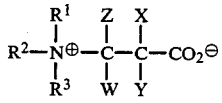
(II)

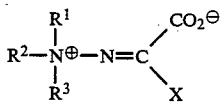
(III)

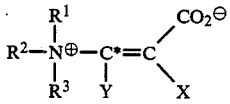
(IV)

wherein $R^1$, $R^2$ and $R^3$ each independently represents a hydrogen atom, an alkyl group, a substituted alkyl group, a cycloalkyl group, an alkenyl group, an alkynyl group, an aryl group, a substituted aryl group, an aralkyl group, a substituted aralkyl group, an imino group represented by the formula $$R^4-N=\underset{|}{C}-R^5$$

or an amidino group represented by the formula $$R^4-N=\underset{|}{C}-NR^6R^7;$$

wherein $R^4$ through $R^7$ each independently represents a substituent selected from an alkyl group, a substituted alkyl group, a cycloalkyl group, an alkenyl group, an aryl group, and an aralkyl group or two of said substituents $R^1$ through $R^7$ together form a ring;

W, X, Y and Z each independently represents a hydrogen atom, an alkyl group, a substituted alkyl group, a cycloalkyl group, an alkenyl group, an alkynyl group, an aryl group, a substituted aryl group, an alkoxy group, an aryloxy group, an aralkyl group, a substituted aralkyl group, an alkylcarboxylamino group, an arylcarbonylamino group, a halogen atom, an alkylthio group, an arylthio group, an alkylcarbonyloxy group, an arylcarbonyloxy group, a cyano group, an alkylcarbonyl group, an arylcarbonyl group, an alkylsulfinyl group, an arylsulfinyl group, a carbamoyl group, a substituted carbamoyl group, a sulfamoyl group, a substituted sulfamoyl group, an ureido group, a substituted ureido group, a sulfamoylamino group, a substituted sulfamoylamino group, an alkylsulfonyl group, an arylsulfonyl group, an alkylsulfonylamino group, an arylsulfonylamino group, an alkoxycarbonyl group, an alkoxycarbonylamino group, an aryloxycarbonyl group, an aryloxycarbonylamino group, a heterocyclic ring, a substituted heterocyclic ring, or said X and Z form a ring.

17. A heat-developable light-sensitive material as in claim 4, wherein said light sensitive material contains a reducing agent.

18. A heat-developable light sensitive material as in claim 4, wherein said light-sensitive material contains an image forming compound which is oxidized as a result of development.

19. A method for forming an image as in claim 16, wherein said heat developable light-sensitive layer comprises a silver halide emulsion layer.

20. A method for producing an image as in claim 19, wherein said light sensitive material contains a reducing agent.

21. A method for producing an image as in claim 19, wherein said light-sensitive material contains an image forming compound which is oxidized as a result of development.

* * * * *